United States Patent [19]

Wiech, Jr.

[11] 4,415,528

[45] Nov. 15, 1983

[54] METHOD OF FORMING SHAPED METAL ALLOY PARTS FROM METAL OR COMPOUND PARTICLES OF THE METAL ALLOY COMPONENTS AND COMPOSITIONS

[75] Inventor: Raymond E. Wiech, Jr., San Diego, Calif.

[73] Assignee: Witec Cayman Patents, Limited, Cayman Islands, Cayman Islands

[21] Appl. No.: 245,670

[22] Filed: Mar. 20, 1981

[51] Int. Cl.[3] ..... B22F 3/00

[52] U.S. Cl. ..... 419/46; 419/36; 419/58

[58] Field of Search ..... 75/200, 224; 419/36, 419/46, 58

[56] References Cited

U.S. PATENT DOCUMENTS

| | | | |
|---|---|---|---|
| 1,040,699 | 10/1912 | Weich | 75/200 |
| 1,922,038 | 8/1936 | Hardy | 75/224 |
| 4,314,849 | 2/1982 | Ro et al. | 75/200 |

OTHER PUBLICATIONS

*Powder Metallurgy Equipment Manual,* 1977, pp. 132–137.

*Primary Examiner*—Gregory A. Heller
*Attorney, Agent, or Firm*—Jay M. Cantor

[57] ABSTRACT

A method of forming precision metal alloy shaped parts starting with small particles of the individual metals and/or individual compounds containing the metals of the targeted metal alloy and a binder. A mix is initially formed of metals and/or compounds of the metals required to form a targeted alloy wherein the metal percent of each metal and/or compound is provided whereby the targeted alloy will be provided. The sizes of the particles of the metals and/or alloys are as small as possible and preferably in the range from one tenth of a micron to ten microns. These particles are mixed with an appropriate binder to form a homogeneous mass.

The mixture is utilized in the formation of parts wherein green bodies are formed by classical techniques and further processing of the green body takes place whereby the green body is stripped of binder and the stripped body is raised to a temperature below the sintering temperature of the metals and sufficiently high to cause net reduction of any metal compound and prevent net oxidation of any metal in the processing atmosphere. The temperature is also maintained whereby operation takes place on the reducing side of the equilibrium curve of the furnace atmosphere for the metals being alloyed and sintered, frequently controlled by dew point of the atmosphere versus temperature for the conditions present. The green body is maintained in this atmosphere for a sufficient period of time whereby substantially all of the metal and/or metal compounds are in the pure metallic state. The temperature is then raised to the sintering temperature and the system is maintained at the sintering temperature for the metals involved while maintaining the system in the reducing region of said equilibrium curve or a suitable neutral atmosphere until sintering is completed. The sintered part displays homogeneous alloy properties and forms the targeted alloy.

18 Claims, 1 Drawing Figure

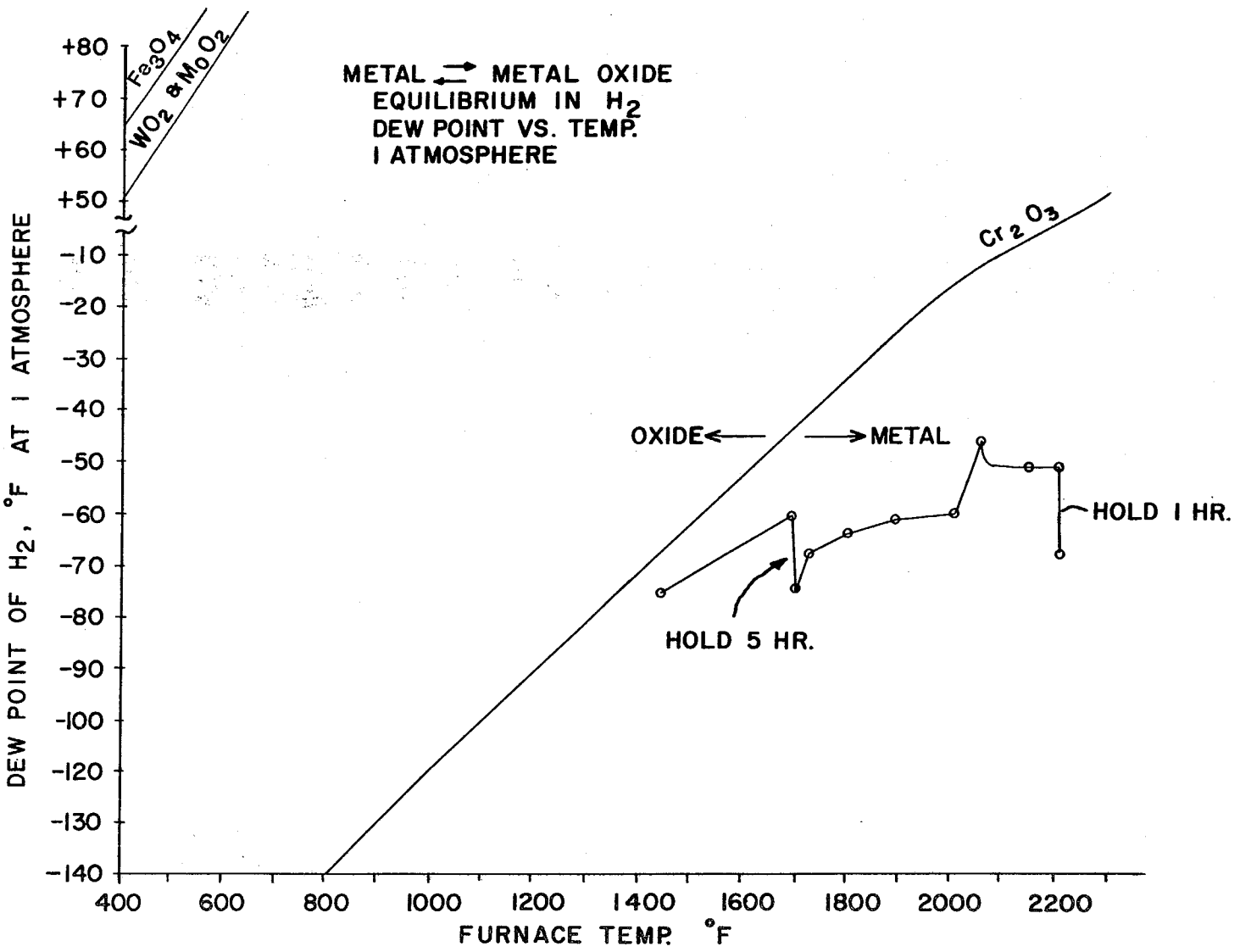
METAL ⇄ METAL OXIDE
EQUILIBRIUM IN $H_2$
DEW POINT VS. TEMP.
1 ATMOSPHERE
$Fe_3O_4$
$WO_2$ & $MoO_2$
$Cr_2O_3$
OXIDE ← → METAL
HOLD 1 HR.
HOLD 5 HR.
DEW POINT OF $H_2$, °F AT 1 ATMOSPHERE
+80
+70
+60
+50
-10
-20
-30
-40
-50
-60
-70
-80
-90
-100
-120
-130
-140
400
600
800
1000
1200
1400
1600
1800
2000
2200
FURNACE TEMP. °F

METHOD OF FORMING SHAPED METAL ALLOY PARTS FROM METAL OR COMPOUND PARTICLES OF THE METAL ALLOY COMPONENTS AND COMPOSITIONS

BACKGROUND OF THE INVENTION

1. Field of the Invention

The invention relates to a method of forming metal alloy parts from the alloy metal components and/or compounds containing the metal alloy components and the molding composition therefor.

2. Description of the Prior Art

Parts have been formed from alloys of metals in the prior art in several ways. One way is to obtain a block of the alloy metal and then machine the part to the desired shape and dimension. The procedure is obviously costly in that the cost of the final part is dependent upon the number of machine steps required as well as the degree of precision required in the ultimate part. Therefore, as the degree of part complexity increases, the cost of the final part will also increase. In addition, all alloy material which does not result as a portion of the final part becomes scrap and is wasted. A further system of the prior art has been to utilize particles of the alloy material and then provide the final part by conventional press and sinter powder metallurgy techniques. These procedures have provided unsatisfactory results due to their inferior properties. It has also been found that attempts to form parts either from powders of alloys or from powders of the metals themselves which make up the targeted alloy in the appropriate proportions have provided inferior properties due to the oxide formation on the surfaces of the particles which tend to inhibit the sintering operation. It is therefore desirable that a method be provided whereby precision parts can be formed from metal alloys which have all the benefits of the prior art machined parts as well as additional benefits of improved part structure integrity and reduction in cost of the final part.

SUMMARY OF THE INVENTION

The above is accomplished in accordance with the present method of forming precision metal alloy shaped parts starting with small particles of the individual metals and/or individual compounds containing the metals of the targeted metal alloy and a binder. A mix is initially formed of metals and/or compounds of the metals required to form a targeted alloy wherein the metal percent of each metal and/or compound is provided whereby the targeted alloy will be provided. The sizes of the particles of the metals and/or alloys are as small as possible and preferably in the range from one tenth of a micron to ten microns. These particles are mixed with an appropriate binder to form a homogeneous mass.

The mixture is utilized in the formation of parts wherein green bodies are formed by classical techniques and further processing of the green body takes place whereby the green body is stripped of binder and the stripped body is raised to a temperature below the sintering temperature of the metals and sufficiently high to cause net reduction of any metal compounds and prevent net oxidation of any metal in the processing atmosphere. The temperature is also maintained whereby operation takes place on the reducing side of the equilibrium curve of the furnace atmosphere for the metals being alloyed and sintered, frequently controlled by dew point of the atmosphere versus temperature for the condition present. The green body is maintained in this atmosphere for a sufficient period of time whereby substantially all of the metal and/or metal compounds are in the pure metallic state. The temperature is then raised to the sintering temperature and the system is maintained at the sintering temperature for the metals involved while maintaining the system in the reducing region of said equilibrium curve until sintering is completed. The sintered part displays homogeneous alloy properties and forms the targeted alloy.

BRIEF DESCRIPTION OF THE DRAWING

The drawing is a graph plotting the dew point of hydrogen in °F. at one atmosphere against furnace temperature for $Cr_2O_3$, $Fe_3O_4$, $WO_2$ and $MoO_2$.

DESCRIPTION OF THE PREFERRED EMBODIMENTS

In order to provide precision parts formed of metal alloys, it is initially necessary to provide an appropriate molding composition. In accordance with the present invention, the molding composition is formed by utilizing small particles of either the metals required to form the desired alloy and/or compounds containing the metal to be used which are appropriately reduceable or changeable under system conditions to the basic metals. In the event a compound is used, the amount of the compound utilized will be based upon thp weight percent of the metal in the compound required in the targeted alloy so that the ultimate alloy has the proper amount of metal therein. The particle sizes can be from about 10 microns down, the smaller the particles the better. A range of one tenth micron to 10 microns is preferred. However, in the case of pure metals, since certain metals, such as chromium, can be highly explosive in very small particle sizes, it is necessary that these pure metals be at the higher end of the range if used in the metallic state. On the other hand, where metal compounds are used and particularly oxides, since the surface energy of these compounds is very small relative to the pure metal, the compounds can be formed in very small sizes down to fractions of a micron and utilized in these sizes without any substantial danger as compared with the pure metal itself. In addition, the necessary alloys and metal constituents are not generally available and, if so, their cost is economically prohibitive. These small particles of the appropriate metals and/or compounds are mixed together with an appropriate prior art binder, such as paraffin, carnauba wax, polyethylene, etc., and combinations thereof to provide a homogeneous mass.

The composition of binder and metal and/or metal compound is then molded to the desired shape to form a green body and the binder is removed therefrom in accordance with prior art techniques. The green body with binder removed is then placed in an oven, kiln or the like having an appropriate reducing or other atmosphere, usually dry oxygen-free hydrogen, to convert all metal compounds to the pure metal and maintain all pure metals in the pure metal state. The temperature in the oven is held at this time below the sintering temperature for the metal involved. The dew point within the furnace is constantly maintained in the reducing range of the equilibrium curve (or to the right of the $Cr_2O_3$ curve in the FIGURE if $Cr_2O_3$ is involved) for all of the metals and/or compounds utilized in the formation of the alloy to be produced or oxides of the metals utilized under the conditions within the system. For example, if a hydrogen atmosphere is being utilized and a stainless steel is to be formed utilizing $Cr_2O_3$, iron and nickel, and if operation is at one atmosphere, the dew point of the system is maintained so that all operation takes place to the right of the $Cr_2O_3$ curve as shown in the FIGURE, this being the reducing region. The oxides of iron and nickel have an equilibrium curve totally to the left of the $Cr_2O_3$ curve as shown.

The temperature in the oven is then raised sufficiently high so that all metal compounds will be reduced or changed to pure metal or other appropriate chemical reaction will take place wherein metal compounds will be reduced or changed to the metal itself with the dew point being retained to the right hand side of the curve as shown in the FIGURE. When all of the metal compounds have been reduced or changed to the pure metal, and due to the very small size of the particles being used, there will be a homogeneous mixture of small metal particles through the body from which the binder has now been removed. The indication that the reduction reaction has gone to completion is found by monitoring the inlet and outlet dew point to and from the furnace. Water will be evolved from the bodies being reduced or sintered as long as oxides are present. The exhaust dew point will fall to the inlet dew point in a gas tight system when all oxides have been reduced. The temperature will then be gradually raised to the sintering temperature of the alloy, the dew point of the system still being maintained in the reducing range as above mentioned and sintering will then take place at the sintering temperature for the required period of time whereby the metal particles will all diffuse into each other to form the desired alloy. The atmosphere can be changed during sintering to neutral or vacuum. The furnace will then be turned off and the final part will be cooled down to room temperature whereupon the completed part is removed from the furnace.

The time required to reduce all compounds to the base metal depends upon the material involved, the atmosphere used, the temperature and the size and geometry of the part. In general, it has been found that firing of a part to the right of the equilibrium curve or in the reducing range for about one hour per 0.05 inches of part thickness will adequatly reduce all compounds to the pure metal.

It has also been found that the procedure as described above provides superior results when the starting powders are themselves the targeted alloy. The reason appears to be that the alloy can also oxidize at the particle surface, thereby preventing full and proper sintering on an economical basis. The present method substantially prevents oxidation of all metal surfaces and reduces any oxidized surfaces to the pure metal alloy.

EXAMPLE I 200 grams of nickel having particle size in the range of 2 to 4 microns were mixed with 1420 grams of iron having a particle size range of 2 to 4 microns and 560 grams of chromium oxide having an average particle size of one-half micron. These materials were mixed with 70.5 grams of paraffin and 70 grams of polyethylene and mixed at a temperature of 150° C. for two hours. A homogeneous mass of thp various materials were formed. A test bar was formed in an injection molding machine utilizing the homogeneous mass. The bar was removed from the molding machine and the binder was removed by placing the green body removed from the machine on a wicking agent composed of ash free paper in an oven heated slowly to a temperature of 200° C. and maintained at 200° C. for a period of three hours. When the binder had been removed from the green body, the body was placed in a furnace into which was fed and circulated hydrogen at a dew point of −75° F. at one atmosphere and the temperature was raised slowly to 1450° F. at a rate of 6° F. per minute. The temperature was then gradually raised at 6° F. per minute to 1700° F. and held at that temperature for five hours. The temperature was then again raised gradually to 2300° F. as rapidly as possible while maintaining the dew point 10° F. from the dew point equilibrium curve and held at that temperature for one hour. The dew point within the system was plotted continually and the plot marks are shown in the FIGURE. The furnace was then turned off and allowed to cool to room temperature whereupon the test bar was removed and inspected. The bar was found to be homogeneous throughout, to be stainless steel and to be non-magnetic.

EXAMPLE II 2151 grams of 316L stainless steel powder having particle size in the range of ten microns and less was mixed with 70.5 grams of paraffin wax, 50 grams of polyethylene and 20 grams of pure refined light flake candelilla wax and one gram of stearic acid and mixed at a temperature of 150° C. for two hours. A homogeneous mass of the various materials were formed. A test bar was formed in an injection molding machine utilizing the homogeneous mass. The bar was removed from the molding machine and the binder was removed by placing the green body removed from the machine on a wicking agent composed of ash free paper in an oven heated slowly to a temperature of 200° C. and maintained at 200° C. for a period of three hours. When the binder has been removed from the green body, the body was placed in a furnace into which was fed and circulated hydrogen at a dew point of −75° F. at one atmosphere and the temperature was slowly raised to 1450° F. at a rate of 6° F. per minute. The temperature was then gradually raised at 6° F. per minute to 1700° F. and held at that temperature for five hours. The temperature was then again raised gradually to 2300° F. as rapidly as possible while maintaining the dew point 10° F. below the dew point equilibrium curve and held at that temperature for ten hours. The furnace was then turned off and allowed to cool to room temperature whereupon the test bar was removed and inspected. The bar was found to be homogeneous throughout, to be stainless steel and to be non-magnetic. The bar had a density of 97% of wrought stainless steel 316L.

It is again emphasized that parts can be produced in the manner noted above from any alloy as long as the metal components of the alloy are available in particulate form as the base metal itself or are available in particulate form in a compound that is convertible to the base metal at temperatures below the sintering temperature of the metal particles during formation of the alloy.

Though the invention has been described with respect to preferred embodiments thereof, many variations and modifications will immediately become apparent to those skilled in the art. It is therefore the intention that the appended claims be interpreted as broadly as possible in view of the prior art to include all such variations and modifications.

I claim:

1. A method of forming shaped metal alloy parts directly from either the individual metals or compounds containing the metal of the targeted alloy or both comprising the steps of:

(a) mixing together small particles taken from the class consisting of metals and metal compounds in an amount corresponding to the weight percentages of the individual metals present in the targeted alloy and an appropriate binder to form a homogeneous mixture of binder and particles, (b) forming said mixture into a predetermined shape, (c) removing said binder from said formed shape, (d) placing said formed shape from (c) in a hydrogen atmosphere and at a temperature to maintain the dew point of said atmosphere on the reducing side of the dew point equilibrium curve for all of the metals forming the targeted alloy to convert all compounds to the metallic state, and (e) sintering said formed shape from (d) in a reducing atmosphere and at a temperature to maintain the dew point of said atmosphere on the reducing side of the dew point equilibrium curve for all of the metals forming the targeted alloy in the sintering atmosphere.

2. The method of claim 1 wherein the particles are oxides of the metals forming the targeted alloy.

3. The method of claim 1 wherein the particles are less than about ten microns in diameter.

4. The method of claim 2 wherein the particles are less than about ten microns in diameter.

5. The method of claim 3 wherein said particles comprise chromium oxide, iron oxide and nickel oxide.

6. The method of claim 3 wherein said particles comprise chromium oxide, iron and nickel.

7. The method of claim 3 wherein said particles comprise chromium oxide, iron oxide and nickel.

8. The method of claim 3 wherein said particles comprise chromium oxide, iron and nickel oxide.

9. A method of forming shaped metal alloy parts directly from either the individual metals or compounds containing the metals of the targeted alloy or both comprising the steps of:

(a) mixing together small particles taken from the class consisting of metals and metal compounds in an amount corresponding to the weight percentages of the individual metals present in the targeted alloy and an appropriate binder to form a homogeneous mixture of binder and particles, (b) forming said mixture into a predetermined shape, (c) removing said binder from said formed shape, (d) placing said formed shape from (c) in a hydrogen atmosphere to convert said compounds and the oxides of all metals in the targeted alloy to the pure metal while maintaining the dew point of said atmosphere on the reducing side of the dew point equilibrium curve for all of the metals forming the targeted alloy to convert all compounds to the metallic state, and (e) sintering said formed shape from (d) in an atmosphere that will convert said compounds and the oxides of all metals in the targeted alloy to the pure metal while maintaining the dew point of said atmosphere on the reducing side of the dew point equilibrium curve for all of the metals forming the targeted alloy in the sintering atmosphere.

10. The method of claim 9 wherein the particles are oxides of the metals forming the targeted alloy.

11. The method of claim 10 wherein the particles are less than about ten microns in diameter.

12. The method of claim 10 wherein the particles are less than about ten microns in diameter.

13. The method of claim 11 wherein said particles comprise chromium oxide, iron oxide and nickel oxide.

14. The method of claim 11 wherein said particles comprise chromium oxide, iron and nickel.

15. The method of claim 11 wherein said particles comprise chromium oxide, iron oxide and nickel.

16. The method of claim 11 wherein said particles comprise chromium oxide, iron and nickel oxide.

17. A method of forming shaped metal alloy parts directly from particles of the alloy comprising the steps of:

(a) mixing together small metal particles of said alloy and an appropriate binder to form a homogeneous mixture of binder and particles, (b) forming said mixture into a predetermined shape, (c) removing said binder from said formed shape, (d) placing said formed shape from (c) in a hydrogen atmosphere and at a temperature to maintain the dew point of said atmosphere on the reducing side of the dew point equilibrium curve for all of the metals of the alloy to convert all compounds to the metallic state, and (e) sintering said formed shape from (d) in a reducing atmosphere and temperature while maintaining the dew point of said atmosphere on the reducing side of the dew point equilibrium curve for all of the metals of the alloy in the sintering atmosphere.

18. The method of claim 17 wherein the particles are less than about ten microns in diameter.

* * * * *